US011447307B2

(12) United States Patent
Croibier et al.

(10) Patent No.: US 11,447,307 B2
(45) Date of Patent: Sep. 20, 2022

(54) PACKAGING SERVICE CAPSULE FOR COSMETIC PRODUCT, AND ASSOCIATED PACKAGING DEVICE

(71) Applicant: L'OREAL, Paris (FR)

(72) Inventors: Sébastien Croibier, Clichy (FR); Etienne Valentin, Clichy (FR)

(73) Assignee: L'OREAL, Paris (FR)

( * ) Notice: Subject to any disclaimer, the term of this patent is extended or adjusted under 35 U.S.C. 154(b) by 81 days.

(21) Appl. No.: 16/959,811

(22) PCT Filed: Jan. 3, 2019

(86) PCT No.: PCT/EP2019/050082

§ 371 (c)(1),
(2) Date: Jul. 2, 2020

(87) PCT Pub. No.: WO2019/134931

PCT Pub. Date: Jul. 11, 2019

(65) Prior Publication Data

US 2020/0369440 A1 Nov. 26, 2020

(30) Foreign Application Priority Data

Jan. 3, 2018 (FR) ..... 18 50024

(51) Int. Cl.
*B65D 47/08* (2006.01)
*A45D 34/00* (2006.01)

(52) U.S. Cl.
CPC ..... *B65D 47/0809* (2013.01); *A45D 34/00* (2013.01); *A45D 2034/002* (2013.01); *B65D 2251/0025* (2013.01); *B65D 2547/063* (2013.01)

(58) Field of Classification Search
CPC .. A45D 34/00; A45D 40/00; A45D 2034/002; B65D 47/0809; B65D 47/0814; B65D 2251/0025; B65D 2547/063
See application file for complete search history.

(56) References Cited

U.S. PATENT DOCUMENTS

| | | | | |
|---|---|---|---|---|
| 6,374,726 | B1 | 4/2002 | Melton | |
| 6,505,986 | B1 | 1/2003 | Oder | |
| 2005/0133544 | A1* | 6/2005 | Tadlock | B05B 11/0078 222/464.2 |
| 2011/0155629 | A1* | 6/2011 | Debauge | A45D 34/00 206/581 |
| 2014/0131230 | A1* | 5/2014 | Steininger | A47G 19/2205 215/6 |

(Continued)

*Primary Examiner* — J C Jacyna
(74) *Attorney, Agent, or Firm* — Polsinelli PC

(57) ABSTRACT

The service capsule (20) comprises:—an outer skirt (32),—a transverse wall (34) defining at least one outlet orifice (48). The service capsule (20) includes, for each orifice (48), a dispensing conduit (36) defining a dispensing passage (51). The service capsule (20) includes a closing cap (40), mounted moving between a clear position and a position applied on the transverse wall (34). A filter (38) is arranged upstream from and/or in the product dispensing conduit (36), and is configured so that the cosmetic product (12) in the container (18) necessarily passes through the filter (38) when the product (12) is extracted from the container (18) through the service capsule (20). The filter (38) is integral with the product dispensing conduit (36).

21 Claims, 3 Drawing Sheets

(56) References Cited

U.S. PATENT DOCUMENTS

Figure 1:
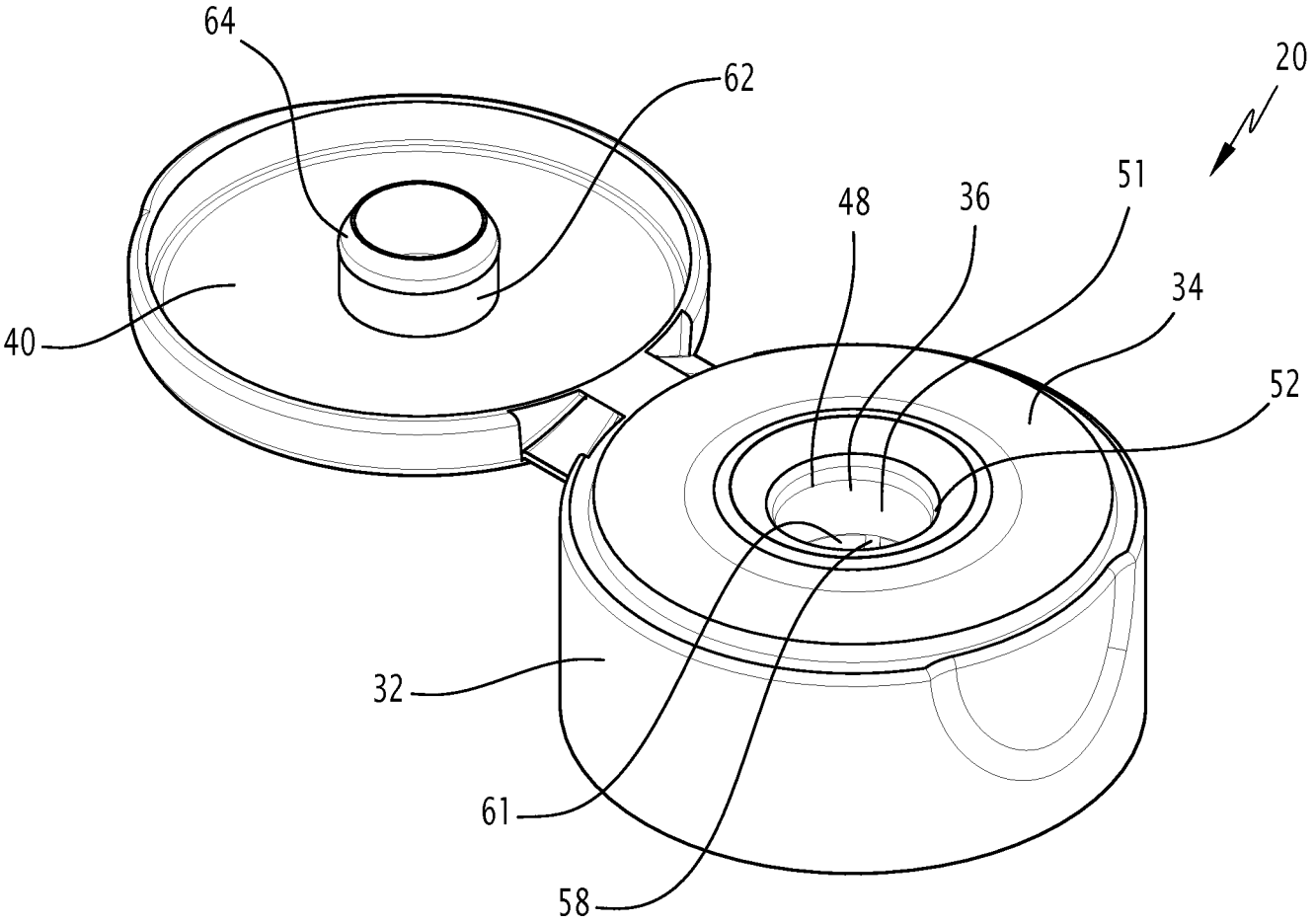

| | | | | |
|---|---|---|---|---|
| 2015/0144662 | A1* | 5/2015 | Lim | A45D 33/02<br>222/190 |
| 2015/0209810 | A1* | 7/2015 | Bibette | B01F 23/50<br>222/1 |
| 2015/0329255 | A1* | 11/2015 | Rzepecki | B65D 47/0885<br>222/189.06 |
| 2020/0229576 | A1* | 7/2020 | Castex | A45D 34/04 |

* cited by examiner

PACKAGING SERVICE CAPSULE FOR COSMETIC PRODUCT, AND ASSOCIATED PACKAGING DEVICE

CROSS REFERENCE TO RELATED APPLICATIONS

This application is a National Phase filing under 35 U.S.C. § 371 of PCT/EP2019/050082 filed on 3 Jan. 2019; which application in turn claims priority to Application No. 18 50024 filed in France on 3 Jan. 2018. The entire contents of each application are hereby incorporated by reference.

The present invention relates to a capsule intended to be mounted on a neck of a cosmetic product packaging container, the service capsule comprising:

an outer skirt intended to engage around the neck, a transverse wall closing off the outer skirt, the transverse wall defining at least one cosmetic product outlet orifice, the service capsule including, for the or each outlet orifice, a product dispensing conduit protruding in the outer skirt from the transverse wall along a conduit axis, the conduit defining a cosmetic product dispensing passage from the container;

the service capsule including a closing cap, mounted movably relative to the transverse wall between a position clear of the transverse wall, allowing the passage of cosmetic product, and a position applied on the transverse wall, preventing the passage of cosmetic product.

Such a service capsule is in particular intended to be used with cosmetic products containing inclusions to prevent inclusions contained in the cosmetic product from leaving the container.

The cosmetic product is in particular a care, coloring and/or makeup product for a bodily surface. In particular, the cosmetic product is a care product for the face and/or hair, or a sun protection product.

A cosmetic product is more generally a product as defined in EC Regulation no. 1223/2009 by the European Parliament and the Council dated Nov. 30, 2009, relative to cosmetic products.

The service capsules generally used to close packaging containers for cosmetic products are not suitable for dispensing a cosmetic product containing inclusions. The user therefore recovers the inclusions when they exit with the product, which is not pleasant to the touch.

U.S. Pat. No. 6,374,726, US 2014/0131230 and U.S. Pat. No. 7,461,587 describe beverage packaging containers provided with stoppers having a filter.

U.S. Pat. No. 5,417,860 describes an insert provided with a tubular filter intended to be inserted into a wine bottle to filter the impurities from the wine.

The insert provided with the filter is, however, complicated to manufacture. It includes several parts made from different materials, which increases the number of parts to be assembled and referenced.

One aim of the invention is to obtain a service capsule usable to dispense a cosmetic product containing inclusions that is easy to manufacture and use.

To that end, the invention relates to a service capsule of the aforementioned type, wherein a filter is arranged upstream from and/or in the product dispensing conduit, the filter being configured so that the cosmetic product present in the container necessarily passes through the filter when the product is extracted from the container through the service capsule, the filter being integral with the product dispensing conduit.

Thanks to the presence of a filter, the service capsule allows the effective dispensing of a cosmetic product containing inclusions, without unpleasantness for the user. Due to the smaller number of components of the service capsule, the service capsule according to the invention nevertheless remains very easy to manufacture.

According to alternatives, in the position applied on the transverse wall, the cap closes the or each outlet orifice; and the cap comprises a sealing finger inserted in a watertight way into the dispensing conduit in the applied position.

In its position applied on the transverse wall, the cap is able to completely prevent the cosmetic product from leaving the container, since each outlet orifice is then covered by the cap. The sealing finger further improves the sealing of the service capsule.

According to one alternative, the dispensing conduit has an upper edge for connecting to the transverse wall and a lower edge, the filter extending from the lower edge.

The configuration of the filter connected to the lower edge of the dispensing conduit prevents obstructing the dispensing conduit upstream from the filter and provides better guiding of the cosmetic product toward the outside of the container after filtering.

According to one alternative, the filter has a pyramidal shape having an apex and an axis corresponding to the conduit axis, the apex being oriented away from the transverse wall.

The pyramidal shape of the filter increases the cosmetic product passage surface, without increasing the size of the orifices. Furthermore, this shape limits the risk of agglutination of inclusions on the filter.

According to one alternative, the filter has a flat shape extending substantially perpendicular to the conduit axis.

The flat shape of the filter allows easier manufacturing, while providing good filtering quality.

According to alternatives, the method comprises at least one member for attaching the outer skirt on the neck protruding from an inner surface of the outer skirt; and the fixing member is a thread able to cooperate with a complementary thread of the neck on the container.

The fixing member, preferably in the form of a net, provides a better fixing of the service capsule on the neck of the container.

According to one alternative, the method comprises an inner sealing skirt protruding in the outer skirt from the transverse wall, the inner skirt and the outer skirt delimiting an annular space for receiving the neck of the container in a watertight way.

The annular space being able to receive the neck of the container, the inner skirt improves the sealing of the service capsule around the neck and limits the risk of product leakage.

According to one alternative, the inner skirt protrudes to a free edge, the filter being arranged at least partially past the free edge along the conduit axis while moving away from the transverse wall.

This configuration provides a simple exit of the cosmetic product from the container, while guaranteeing a good filtering quality.

The invention also relates to a device for packaging and dispensing cosmetic product comprising a container able to receive cosmetic product, the container having a neck, and a service capsule as defined above, mounted on the neck.

In specific embodiments of the invention, the packaging device further has the following feature:

the container contains a cosmetic product having inclusions; and the size of the inclusions being between 2 $mm^3$ and 800 $mm^3$.

Figure 2:
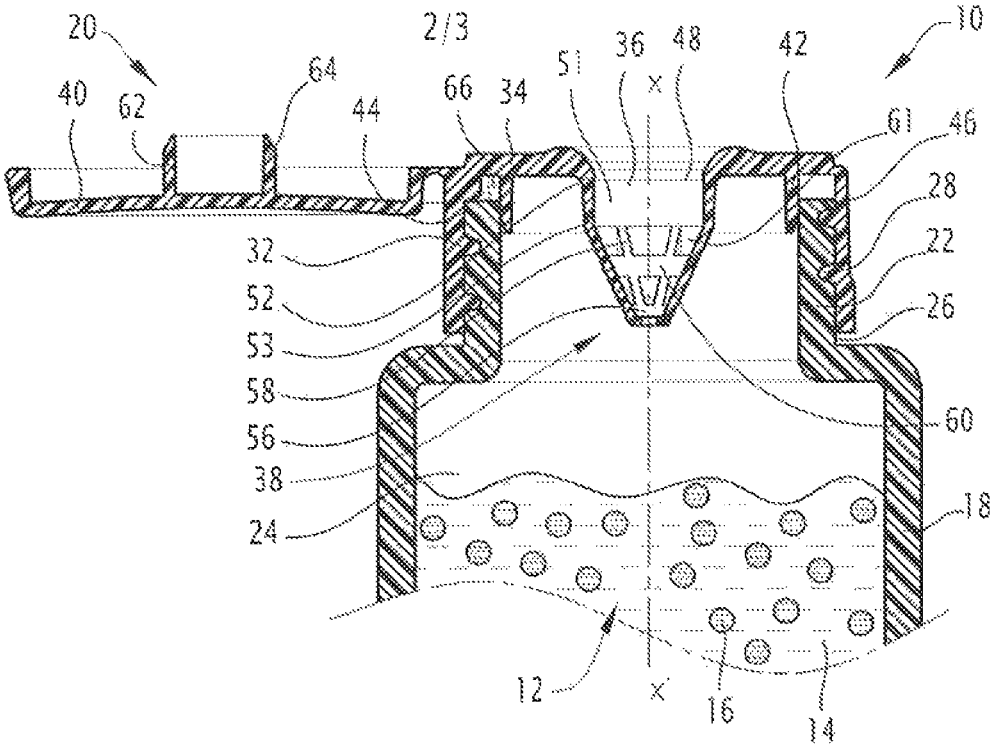
Figure 3:
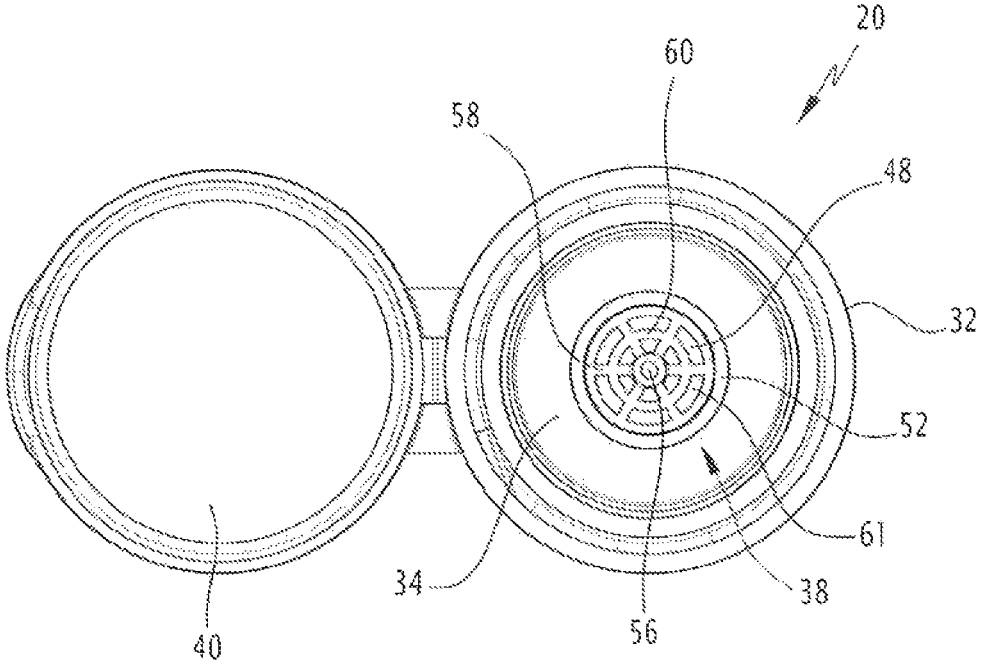
Figure 4:
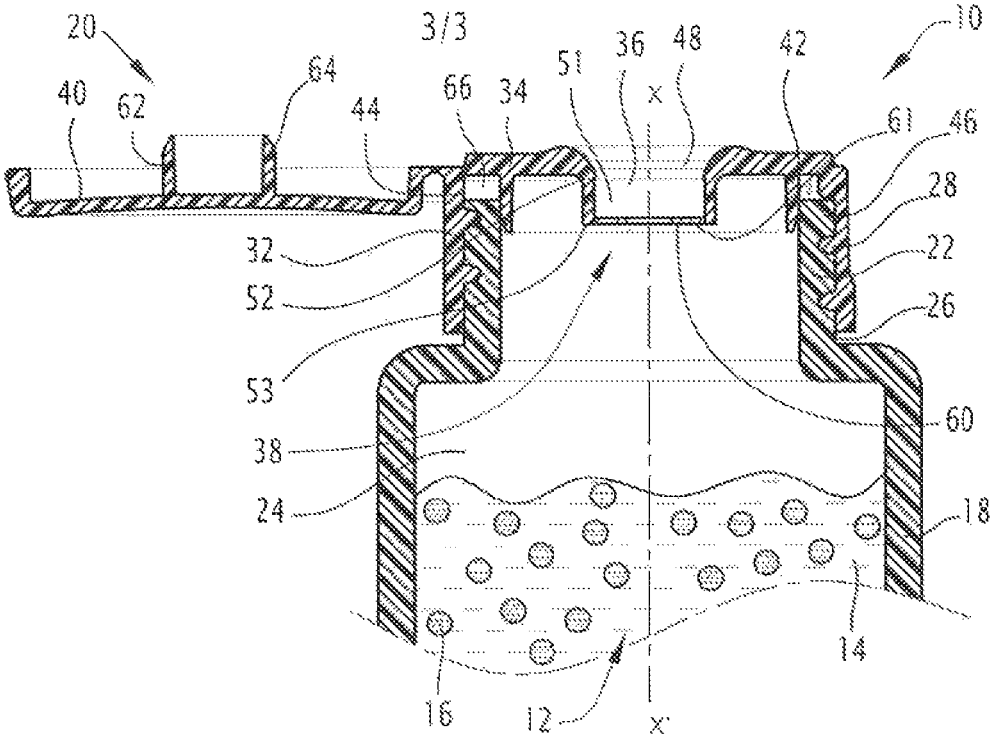
Figure 5:
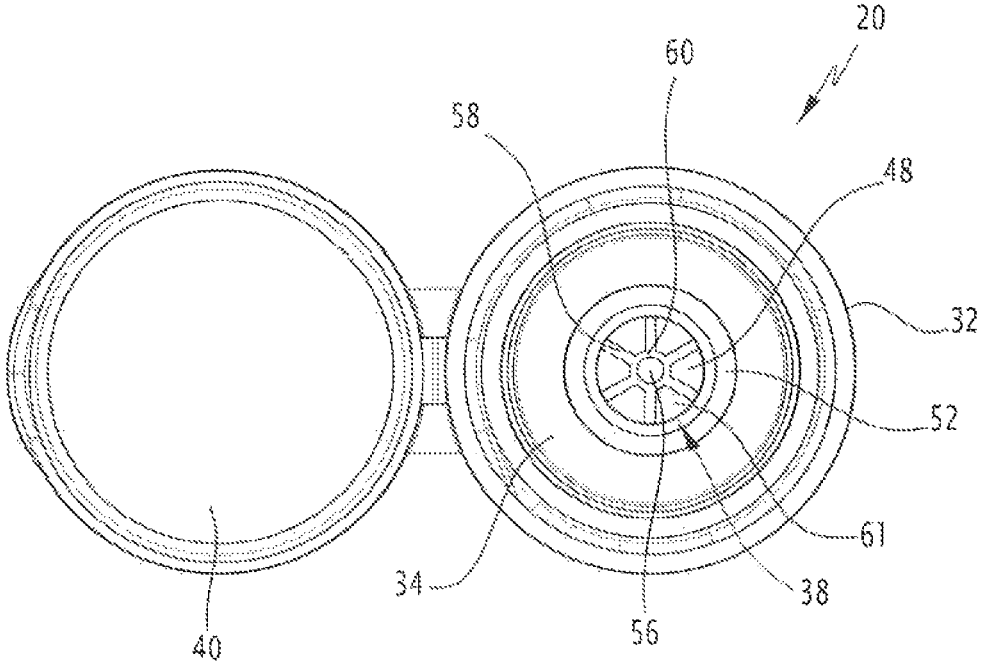

Other features and advantages of the invention will appear upon reading the following description, provided solely as an example and done in reference to the appended drawings, in which:

FIG. 1 is a perspective view of a first service capsule according to the invention, the cap being in its clear position, FIG. 2 is a sectional view along a median axial plane of the service capsule of FIG. 1, the service capsule being mounted on a neck of a container, FIG. 3 is a bottom view of the service capsule of FIG. 1, FIG. 4 is a sectional axial view of a second service capsule according to the invention, and FIG. 5 is a bottom view of the service capsule of FIG. 4.

A first packaging and dispensing device 10 according to the invention is illustrated in FIG. 2. This device 10 is intended to package and dispense a cosmetic product 12.

The cosmetic product 12 is for example a care, coloring and/or makeup product.

The cosmetic product 12 includes a liquid 14, and solid inclusions 16 dispersed in the liquid 14.

The inclusions 16 for example comprise plant elements, such as flowers, and/or active solid ingredients. The volume of the inclusions 16 is in particular between 1 $mm^3$ and 1000 $mm^3$, and advantageously between 2 $mm^3$ and 800 $mm^3$.

The quantity of inclusions 16 in the cosmetic product 12 is between 0.05 g/l and 20 g/l, and advantageously between 0.1 g/l and 10 g/l.

The device 10 comprises a container 18, and a service capsule 20 according to the invention mounted on the container 18.

The container 18 is for example made from a plastic material. In one alternative, the container 18 is made from glass or metal.

The container 18 includes a neck 22 extending around a central axis X-X', and a reservoir 24 connected to the neck 22.

The neck 22 defines an outer surface 26 including a complementary thread 28. The thread 28 protrudes, from the outer surface 26, away from the central axis X-X'.

The reservoir 24 defines an inner volume intended to receive the cosmetic product 12.

The service capsule 20 is mounted on the neck 22 of the container 18. It includes an outer skirt 32, and a transverse wall 34 closing the outer skirt 32 toward the outside. The service capsule 20 further includes a product dispensing conduit 36, protruding toward the inside of the container 18 from the transverse wall 34, and a filter 38 arranged upstream from the dispensing conduit 36.

It further includes a closing cap 40 movable relative to the outer skirt 32, and advantageously an inner sealing skirt 42 protruding from the transverse wall 34 to the inside of the outer skirt 32.

The outer skirt 32 is engaged around the neck 22. It extends over the entire periphery of the neck 22 around the axis X-X'.

The outer skirt 32 includes an inner surface 44 oriented toward the central axis X-X'. The inner surface 44 includes a fixing member 46 protruding toward the central axis X-X'. The fixing member 46 here is a thread cooperating with the complementary thread 28 to fasten the service capsule 20 on the neck 22.

The transverse wall 34 closes the outer skirt 32 at its upper edge. It extends substantially perpendicularly to the central axis X-X'.

The transverse wall 34 defines at least one cosmetic product outlet through orifice 48. Advantageously, the central axis X-X' passes through the outlet orifice 48 through its center.

The diameter of the outlet orifice 48 is between 5 mm and 10 mm, advantageously between 7 mm and 9 mm, and is in particular equal to 8.25 mm.

The dispensing conduit 36 protrudes in the outer skirt 32 from the transverse wall 34 along the central axis X-X'.

The dispensing conduit 36 defines a dispensing passage 51 for the cosmetic product 12. The passage 51 emerges outwardly through the outlet orifice 48 and inwardly toward the reservoir 24.

The dispensing conduit 36 extends between an upper connecting edge 52 connected to the transverse wall 34, and a lower edge 53 connected to the filter 38.

The cosmetic product 12 is able to flow from the container 18 through the dispensing passage 51 to the outlet orifice 48.

The filter 38 here extends toward the reservoir 24 from the lower edge 53 of the dispensing conduit 36. The filter 38 is configured so that the cosmetic product 12 present in the container 18 necessarily passes through the filter 38 when the product 12 is removed from the container 18.

The filter 38 is completely received in the inner volume defined by the outer skirt 32. This limits the risks of breaking during transport and rubbing on the tools during packaging in the factory.

According to the invention, the transverse wall 34, the dispensing conduit 36 and the filter 38 are integral. In this example, the inner skirt 42, the outer skirt 32 and the cap 40 are also integral with the transverse wall 34.

In the example shown by FIGS. 1 to 3, the filter 38 has a pyramidal shape having an apex 56 oriented away from the transverse wall 34.

The filter 38 includes at least two membranes 58 tilted toward the axis X-X' and at least one circumferential ring 60 around the axis X-X' delimiting passage holes 61. The membranes 58 connect the apex 56 to the lower edge 53 of the dispensing conduit 36. At least one hole 61 is advantageously provided at the apex 56.

In this example, the filter 38 includes between 2 and 10 membranes 58 distributed angularly, for example 6 membranes 58. The circumferential ring 60 is arranged between the apex 56 and the lower edge 53 to connect the membranes 58. It extends over the entire periphery around the central axis X-X'.

Each passage hole 61 has an area smaller than the size of the inclusions 16. The cumulative passage surface of the holes 61 is greater than the section of the dispensing passage 51, owing to the pyramidal shape of the filter 38.

In one alternative, the thickness of the membranes 58 is greater near the apex 56 relative to the thickness of the membranes 58 near the lower edge 53.

The cap 40 is articulated on the transverse wall 34 and/or on the outer skirt 32. It is mounted movably relative to the transverse wall 34 between a position clear of the transverse wall 34 (visible in the Figures) and a position applied on the transverse wall 34.

In the position applied on the transverse wall 34, the cap 40 closes each outlet orifice 48 and the cosmetic product 12 is prevented from leaving the container 18.

The cap 40 includes a sealing finger 62 intended to be inserted in a watertight way into the dispensing conduit 36 when the cap 40 is in its position applied on the transverse wall 34. It has a length smaller than that of the dispensing conduit 36. When the cap 40 is in its applied position, the sealing finger 62 remains arranged away from the filter 38. This prevents damage to the filter 38 by the sealing finger 62.

In the clear position, the cap 40 has been pivoted away from the transverse wall 34. The outlet orifice 48 is clear. The cosmetic product 12 is able to leave the container 18.

The inner skirt 42 protrudes in the outer skirt 32 from the transverse wall 34 up to a free edge 64. The free edge 64 is arranged below the lower edge 53.

The inner skirt 42 and the outer skirt 32 delimit an annular receiving space 66 intended for receiving the neck 22 of the container 18 in a watertight way.

During operation, when a user wishes to use the cosmetic product 12 contained in the container 18, he first takes the cap 40 from its position applied on the transverse wall 34 to its clear position. The sealing finger 62 leaves the dispensing conduit 36 and frees the dispensing passage 51 for the cosmetic product 12. The outlet orifice 48 is then clear.

Next, he pivots the container 18. Under the effect of gravity and optionally pressure applied on the container 18, cosmetic product 12 moves toward the dispensing conduit 36. The filter 38 arranged on the lower edge 53 of the conduit 36 prevents the inclusions 16 from entering the conduit 36, while allowing the passage of liquid 14 in the conduit 36. Thus, the inclusions 38 are retained by the filter 38 in the container 18.

The liquid 14 without inclusions 16 flows in the conduit 36 to the outlet orifice 48 toward the outside of the container 18. The user then uses the cosmetic product 12 without inclusions 16.

In a second device according to the invention, shown in FIGS. 4 and 5, the filter 38 has a flat shape extending substantially perpendicular to the central axis X-X'. The filter 38 of the second device differs from that of the first device in that the membranes 58 are radial and connect the lower edge 53 to the circumferential ring 60, ending on the circumferential ring 60.

The second device according to the invention is also similar to the first device.

Thanks to the invention described above, the design of the service capsule 20 is simplified. Indeed, the transverse wall 34, the dispensing conduit 36, and the filter 38 and advantageously the cap 40 and the outer skirt 32 being integral, it is therefore possible to manufacture the service capsule 20 using a simple and traditional molding method, while ensuring an adequate operation of the device 10, even in the presence of a cosmetic product containing inclusions.

The invention claimed is:

1. A service capsule intended to be mounted on a neck of a packaging container of cosmetic product, the service capsule comprising:

an outer skirt intended to engage around the neck, a transverse wall closing off the outer skirt, the transverse wall defining at least one outlet orifice of cosmetic product, the service capsule comprising, for the or each outlet orifice, a product dispensing conduit protruding in the outer skirt from the transverse wall along a conduit axis (X-X'), the conduit defining a dispensing passage of cosmetic product from the container;

the service capsule comprising a closing cap, mounted movably relative to the transverse wall between a position clear of the transverse wall, allowing the passage of cosmetic product, and a position applied on the transverse wall, preventing the passage of cosmetic product, the service capsule comprising a filter placed upstream from and/or in the product dispensing conduit, the filter-being configured so that the cosmetic product present in the container necessarily passes through the filter when the product is extracted from the container through the service capsule, the filter being integral with the transverse wall and with the product dispensing conduit.

2. The service capsule according to claim 1, wherein, in the position applied on the transverse wall, the cap closes the or each outlet orifice.

3. The service capsule according to claim 1, wherein the cap comprises a sealing finger inserted in a watertight way into the dispensing conduit in the applied position.

4. The service capsule according to claim 1, wherein the dispensing conduit has an upper edge for connecting to the transverse wall and a lower edge, the filter extending from the lower edge.

5. The service capsule according to claim 1, wherein the filter has a pyramidal shape having an apex and an axis corresponding to the conduit axis-(X-X'), the apex being oriented away from the transverse wall.

6. The service capsule according to claim 1, wherein the filter has a flat shape extending substantially perpendicular to the conduit axis-(X-X').

7. The service capsule according to claim 1, comprising at least one fixing member of the outer skirt on the neck protruding from an inner surface of the outer skirt.

8. The service capsule according to claim 7, wherein the fixing member is a thread able to cooperate with a complementary thread of the neck of container.

9. The service capsule according to claim 1, comprising an inner sealing skirt protruding in the outer skirt from the transverse wall, the inner skirt and the outer skirt delimiting an annular space for receiving the neck of the container in a watertight way.

10. The service capsule according to claim 9, wherein the inner skirt protrudes till a free edge, the filter being placed at least partially past the free edge along the conduit axis (X-X') when moving away from the transverse wall.

11. A packaging and dispensing device for cosmetic product comprising a container able to receive the cosmetic product, the container having a neck, and a service capsule according to claim 1, mounted on the neck.

12. The packaging and dispensing device according to claim 11, wherein the container contains a cosmetic product having inclusions.

13. The packaging and dispensing device according to claim 12, the size of the inclusions being between 2 $mm^3$ and 800 $mm^3$.

14. The service capsule according to claim 2, wherein the cap comprises a sealing finger-inserted in a watertight way into the dispensing conduit in the applied position.

15. The service capsule according to claim 2, wherein the dispensing conduit has an upper edge for connecting to the transverse wall—and a lower edge, the filter extending from the lower edge.

16. The service capsule according to claim 3, wherein the dispensing conduit has an upper edge for connecting to the transverse wall—and a lower edge, the filter extending from the lower edge.

17. The service capsule according to claim 2, wherein the filter has a pyramidal shape having an apex and an axis corresponding to the conduit axis-(X-X'), the apex being oriented away from the transverse wall.

18. The service capsule according to claim 3, wherein the filter has a pyramidal shape having an apex and an axis corresponding to the conduit axis-(X-X'), the apex being oriented away from the transverse wall.

19. The service capsule according to claim 4, wherein the filter has a pyramidal shape having an apex and an axis corresponding to the conduit axis-(X-X'), the apex being oriented away from the transverse wall.

20. The service capsule according to claim 2, wherein the filter has a flat shape extending substantially perpendicular to the conduit axis (X-X').

21. The service capsule according to claim 1, wherein the outer skirt defines an inner volume and wherein the filter is completely received in the inner volume defined by the outer skirt.

* * * * *